US007053287B2

(12) United States Patent
Dam

(10) Patent No.: US 7,053,287 B2
(45) Date of Patent: May 30, 2006

(54) COMPENSATOR FOR A TREMOLO AND A MUSICAL INSTRUMENT

(75) Inventor: Marcellinus Bonefatius Maria Dam, Opmeer (NL)

(73) Assignee: Dirckson C.V., Opmeer (NL)

( * ) Notice: Subject to any disclaimer, the term of this patent is extended or adjusted under 35 U.S.C. 154(b) by 258 days.

(21) Appl. No.: 10/440,004

(22) Filed: May 15, 2003

(65) Prior Publication Data

US 2004/0000224 A1 Jan. 1, 2004

Related U.S. Application Data

(63) Continuation-in-part of application No. 09/171,048, filed on Nov. 14, 2002, now Pat. No. Des. 487,425.

(30) Foreign Application Priority Data

May 31, 2002 (NL) ..... 213023001

(51) Int. Cl.
*G10D 3/00* (2006.01)

(52) U.S. Cl. ..... 84/313

(58) Field of Classification Search ..... 84/313, 84/312 R, 318, 321; 348/226.11
See application file for complete search history.

(56) References Cited

U.S. PATENT DOCUMENTS

| | | | | | |
|---|---|---|---|---|---|
| 4,546,306 | A | | 10/1985 | Alba et al. | |
| 4,549,130 | A | | 10/1985 | Dobberstein | |
| 5,959,224 | A | * | 9/1999 | McCune | 84/313 |
| 2002/0194977 | A1 | * | 12/2002 | Hirayama | 84/313 |

* cited by examiner

*Primary Examiner*—Kimberly Lockett
(74) *Attorney, Agent, or Firm*—Peacock, Myers & Adams, P.C.

(57) ABSTRACT

A compensator for a tremolo for a stringed musical instrument, such as an electric guitar. The compensator has an integrated tremolo stop, allowing a musician to continue playing without undue delay in the event a string breaks.

7 Claims, 2 Drawing Sheets

COMPENSATOR FOR A TREMOLO AND A MUSICAL INSTRUMENT

CROSS-REFERENCE TO RELATED APPLICATIONS

This application is a continuation-in-part application of U.S. Design Patent Application Ser. No. 29/171,048, entitled "Stabilizing Tremolo Transformer", to Marcellinus Bonefatius Maria Dam, filed on Nov. 14, 2002 now U.S. Des. Pat. No. D487,425, which claimed the benefit of the filing of International Design Application No. 213023001, filed May 31, 2002, and the specifications thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to a compensator for a tremolo.

2. Description of Related Art

The present invention relates to a compensator for a tremolo. Stringed musical instruments, in particular a guitar or more specifically an electric guitar may be provided with a tremolo system. A tremolo allows a musician playing the musical instrument to vary the tension on the strings. A typical musical instrument has a body with a neck. At a front side of the musical instrument a plurality of strings is provided, stretching from a distal end of the neck to and over part of the body. The strings are connected to a tremolo body of the tremolo system. The tremolo body can be pivotted around a fulcrum using an arm attached to the tremolo body. The fulcrum may comprise a hinge joining the tremolo body via a tremolo bridge to the body of the musical instrument. However, it is preferred that one of the tremolo body and the tremolo bridge comprise a knife edge and the other part a matching groove.

The strings of the musical instrument are under high tension. As the tremolo body can pivot around the fulcrum, the high tension of the strings would be relieved, for which reason a compensating means is required in a tremolo system. This compensating means is conveniently located in a recessed space, generally at the rear of the musical instrument, where it is connected with a distal end of the compensating means to the body of the musical instrument. In case the recessed space is at the rear, a through-hole is provided in the body, allowing a lever arm to connect the tremolo body to a proximal end of the compensating means. The compensating means comprises springs to compensate for the tension of the strings. The force with which these springs act must be adjustable in strength in order to maintain the desired tension. Hence, the compensating means comprises a device designated as a compensator, which possesses adjusting means.

A known compensator, disclosed in U.S. Pat. No. 4,928,564, which is incorporated herein by reference, comprises a bracket shaped like an elongated U, having a first, proximal end and a second distal end. The bracket is connected at a distal end to the body of the musical instrument. A rod is connected to the lever arm of the tremolo. The rod is passed through an opening in the proximal end of the bracket along the length of the bracket. Between the bracket ends a tube is provided sleeved over part of the length of said rod between the two bracket ends, the tube being capable of moving through the opening of the first proximal end but unable to pass it due to a nut. A first compression spring is sleeved over the tube and abuts against the first, proximal end and an adjustment wheel. The latter allows adjustment of the amount of compression exerted on the compression spring. This changes amount of effort with which the tremolo arm has to be operated to achieve a certain change in pitch. The first compression spring helps to overcome "sticky" strings, where friction (of among others strings and knife edge), does not allow the tremolo body to return to its original free-floating position, the position in which the instrument is in tune (neutral pitch). Between the adjustment wheel and the second, distal end an anchor is attached to the rod. Between adjustment wheel and the anchor a second compression spring is provided, which second compression spring is weaker than the first compression spring. By selecting the position of the anchor on the rod, it is possible to determine over what angle the tremolo arm can be moved before the first compression spring is engaged. In other words, when the help of the first compression spring is invoked to return the tremolo body to its original position. The second compression spring serves to keep the bracket in place when the pitch is raised. It also helps to soften the impact with which the anchor engages the first compression spring.

If a string breaks during playing the instrument, the balance between the compensating means and the strings is disturbed. As a result, the musical instrument is instantly out of tune. Replacing the broken string is very time-consuming. This could ruin a show or performance. To this end, it is known to employ a tremolo stop. Such a tremolo stop may be provided at the front side of the musical instrument (as disclosed in EP 0,338,523). This does not improve the looks of the musical instrument. In addition, there is the risk that clothes, such as a sleeve, or jewelry, such as a bracelet, are caught, which would hinder the musician. Alternatively, the tremolo stop may be housed in the recessed space housing the compensating means. This is disclosed in U.S. Pat. No. 4,555,970. However, generally, there is little room in the recessed space to house the tremolo stop. To prevent the musician's clothes etc. to be caught by the compensating means, the recessed space is as small as possible. This makes a retrofit difficult. In addition, or alternatively, the recessed space is usually covered with a lid. The lid is provided with openings to allow making adjustments to the compensating means. For the above reason, it is desirable to keep the number and size of the openings as small as possible.

The object of the present invention is to provide a compensator having an integrated tremolo stop which allows the musician to resume playing with a minimum of delay after string breakage, and to provide ready access to the tremolo stop while keeping the number and size of the openings as small as possible.

BRIEF SUMMARY OF THE INVENTION

The object of the present invention is to provide a compensator having an integrated tremolo stop which, in the event of a string breaking, enables a musician to resume playing with a minimal delay, and to provide ready access to the tremolo stop while keeping the number and size of the openings as small as possible.

According to the invention, the compensator comprises a rod, an elongated frame and an anchor means, the elongated frame having a first and a second frame end portion, the frame end portions being provided with an opening with respect to and through which the rod is capable of being moved, wherein the anchor means is attached to the rod;

a tube sleeved over said rod between the first frame end over part of the length of the rod between the first frame end portion and the anchor means, the tube being provided with threading and an adjustment wheel, a compression spring being sleeved over the tube and abutting against the first frame end portion;

an integrated tremolo stop, the tremolo stop comprising a hollow second adjustment wheel provided between the anchor means and the second frame end portion, where one of the anchor body and the hollow second adjustment wheel comprises a hollow bush sleeved over the rod, the hollow bush is provided with a thread, and the other of the anchor body and the second adjustment wheel is provided with a complementary thread, the rod being movable with respect to and through the hollow second adjustment wheel.

By turning the adjustment wheel such that it abuts the second frame end portion, the rod moves the lever arm of the tremolo reducing the tension on the strings. In other words, when mounted in a musical instrument, the tension exerted on the tremolo will be varied by turning the adjustment wheel, effectively tuning all strings. In particular with electric guitars, where the musician usually has an electronic tuning device at his disposal, retuning of the guitar can be achieved in a matter of seconds by turning the adjustment wheel. Such electronic devices electronically indicate on a display the degree to which the guitar is out of tune.

The present invention also relates to an electric guitar equiped with a compensator having an integrated tremolo stop.

The present invention will now be illustrated with reference to the following non-limiting embodiments.

DETAILED DESCRIPTION OF THE INVENTION

Figure 1:
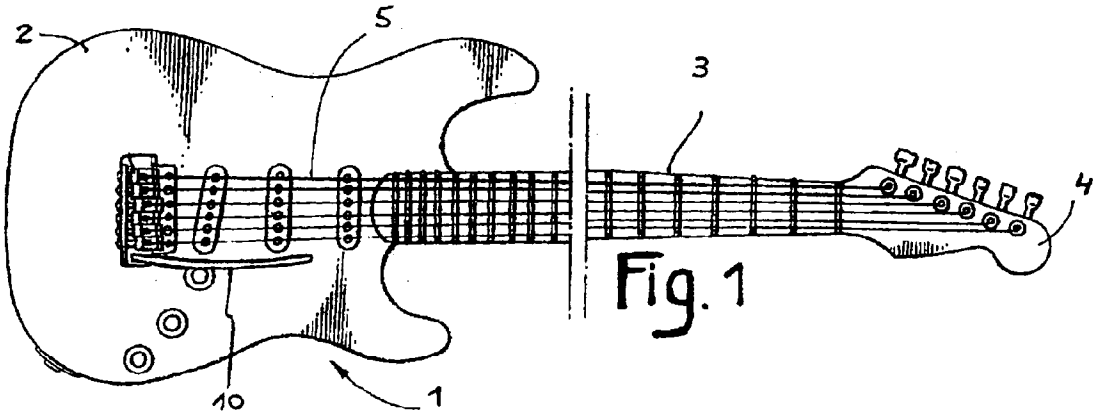
FIG. 1 is a front view of an electric guitar provided with a tremolo system.
Figure 2:
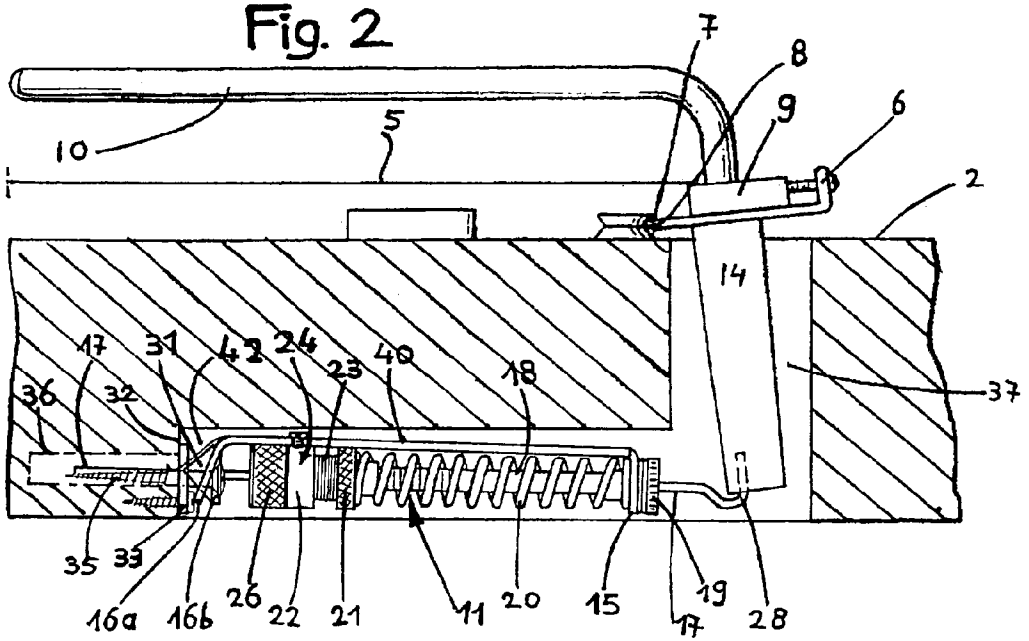
FIG. 2 shows a partial side cross-sectional view of the electric guitar of FIG. 1 showing a compensating means of the tremolo system.

FIG. 1 shows a front view of an electric guitar 1. The electric guitar 1 comprises a body 2 and a neck 3. At a distal end from the body 2, the neck 3 comprises a head 4 provided with customary means for attaching strings 5. As the ordinary person skilled in the art is well-acquainted with this end of the instrument, no further elucidation is deemed necessary. As can be seen in FIG. 2, a tremolo bridge 6 provided with a groove 7 is attached to the body 2. A knife edge 8 of a tremolo body 9 fits into the groove, providing a fulcrum for the tremolo body 9. At least two strings 5 are connected to the tremolo body 9. For the sake of simplicity of the description, it will be assumed that all strings are attached to the tremolo body 9. The tension on the strings 5 can be varied by actuating an arm 10. In the embodiment shown, moving the arm 10 toward the body 2 reduces the tension of the strings 5 (lowering the pitch), whereas pivotting the arm 10 away from the body 10 increases the tension (increasing the pitch). So, in such a mode, called a free floating position of the tremolo body 9, either action changes the pitch of a vibrating string 5. To keep the strings 5 under an appropriate tension, a compensating means 11 is provided. In the embodiment shown, the compensating means 11 is provided in a recessed space 42 at the back of the guitar 1. It may be provided with an optional lid (not shown) containing one or more openings for accessing the compensating means 11 during playing, as will be clear from the explanation below. Such a lid is known in the art and does not require any further explanation. The compensating means comprises, in the preferred embodiment shown in FIG. 3, two essentially non-adjustable draw springs 12, 12' and a compensator 13. It is generally desired that the springs 12, 12' have the same spring constant. Similarly, it is preferred that the compensator 13 is located at equal distances from the springs 12, 12'. The compensating means 11 is connected to the tremolo body 9 via a lever arm 14 which is inserted in a through-hole 37 in body 2. The springs 12, 12' are connected to both the body 2 and to the lever arm 14, which is known in itself, for example from U.S. Pat. No. 4,928,564.

Figure 3:
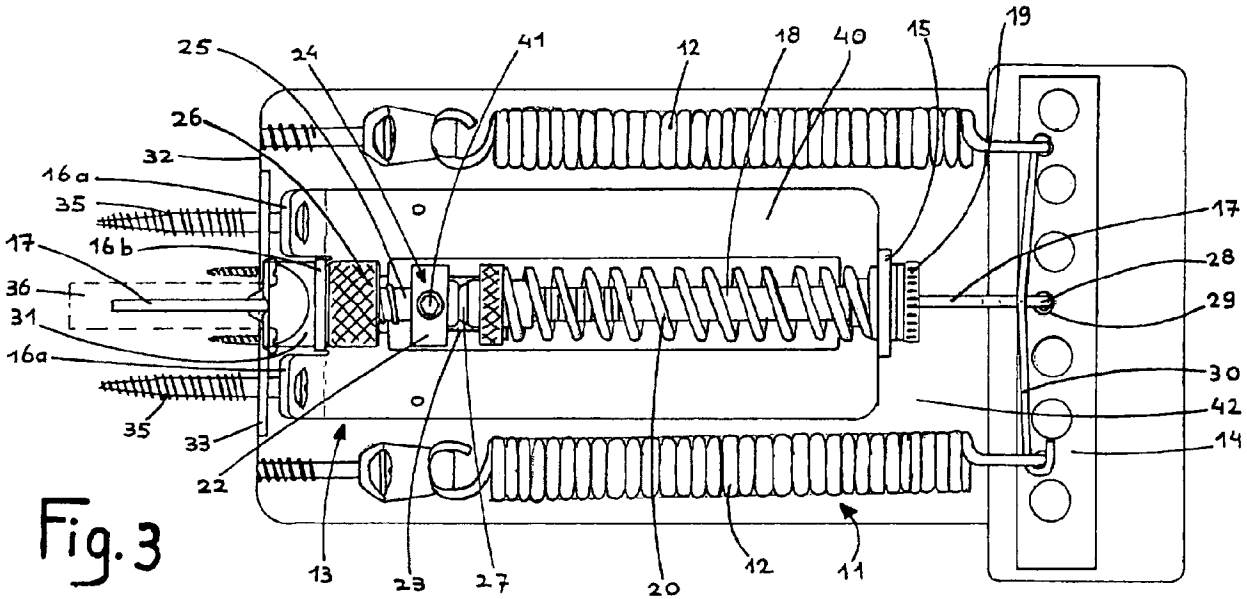
FIG. 3 is a partial rear view schematically showing compensating means of a tremolo system in a recessed space in the electric guitar of FIG. 1.

The preferred embodiment of the compensator 13 shown in FIG. 3 comprises an elongated, substantially rigid frame 40 having a first end portion 15 and a second end portion 16. The first end portion 15 faces the lever arm 14. In the embodiment shown, the second end 16 rests against the body 2. Both end portions 15 and 16 are provided with through-holes (not visible) or recesses allowing passage of a rod 17 connected to the lever arm 14 along the frame 40.

Between the end portions 15 and 16 a threaded tube 18 is provided sleeved over part of the length of said rod 17 between the two end portions 15 and 16. The tube 18 is capable of moving through the opening of end portion 15, but cannot pass it due to a nut 19. A first compression spring 10 is sleeved over the tube 18 and abuts against the first end portion 15 and an adjustment wheel 21. The latter allows adjustment of the amount of compression of the first compression spring 20. This changes the amount of effort with which the tremolo arm has to be operated (when lowering the pitch) to achieve a certain change in pitch. The first compression spring 20 helps to overcome "stiky" strings, where friction (of among others and knife edge), does not allow the tremolo body 9 to return to its original free-floating position, the position in which the electric guitar 1 is in tune (neutral pitch). Between the adjustment wheel 21 and the second end portion 16 an anchor 22 is attached to the rod 17. Between the adjustment wheel 21 and the anchor 22 a second compression spring 23 (shown in cross section in FIG. 3) is provided, which second compression spring 23 is weaker than the first compression spring 20. By selecting the position of the anchor 22 on the rod 17, it is possible to determine over what angle the tremolo arm 10 can be moved before the first compression spring 20 is engaged. In other words, when the help of the first compression spring 20 is invoked to return the tremolo body 9 to its original position. To put the anchor 22 at a desired position on the rod 17, the anchor 22 is provided with fastening means such as a screw 41.

As will be clear from the above, when the arm 10 is moved away from the body 2, the draw springs 12, 12' of the compensating means 11 are contracted. This will also occur if a string 5 breaks. According to the invention, and as can be seen in detail in FIG. 3, the anchor 22 comprises an anchor body 24 provided with a (hollow) threaded bush 25 and an (hollow) adjustment wheel 26 with a thread ensleeving the rod 17 is provided for cooperating with the threaded bush 25 of the anchor 22.

In the event of a string 5 breaking, operating the adjustment wheel 26 allows the space between the adjustment wheel 26 and the anchor body 24 to be varied over a distance such that the second end portion 16 of the frame 40 can serve as a stop for the adjustment wheel 26. FIG. 3 shows the adjustment wheel 26 in the position where it abuts the end portion 16. As a result, the anchor body 24 is forced to move away from the second end portion 16, taking rod 17 with it. In this way, the tremolo body 9 is returned to the position in which the electric guitar 1 is in tune. Now, although a string is broken, the musician may continue playing.

When the adjustment wheel 26 is stopped by the second end portion 16, the tremolo can no longer be used to increase the tension of the strings 5 (i.e. to increase the pitch), but can still be used to reduce the tension of the strings 5 (relative to the tension of the strings 5 when they are tuned).

In particular with electric guitars, where the musician usually has an electronic tuning device at his disposal, retuning of the guitar can be achieved in a matter of seconds by turning the adjustment wheel 26. Such electronic devices electronically indicate on a display the degree to which the guitar is out of tune.

The compensator with integrated tremolo stop according to the invention does not require any additional space in the recessed space 42 because it replaces the current compensator. Existing guitars can be easily retrofitted with the present compensator. Also, the adjustment wheel 26 is very close to the adjustment wheel 21, and can be operated through the same opening (in case of a lid covering the recessed space 42).

The rod 17 may be connected to the lever arm 14 in one of several ways. However, the rod 17 should be connected in such a way that it can push the lever arm 14 if the adjustment wheel 26 is actuated. To this end, the rod 17 may be provided with means, such as a hook 28, as shown in FIG. 2. This hook 28 is inserted into a small hole 29 in the lever arm 14. A clip 30 (not shown in FIG. 2 but visible in FIG. 3) may be used to ensure that the hook 28 can not disengage from the lever arm 14. In contrast with other ways of connecting, such as gluing, this method allows easy removal and installation, and does not alter or damage any part of the guitar 1.

Figure 4:
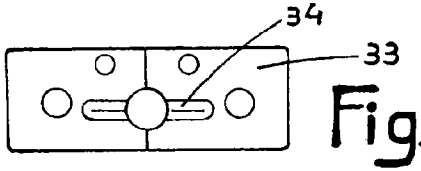
FIG. 4 shows a platelet for use with a preferred embodiment of a compensating means.

The compensator means 13 may be connected to the body 2 in a variety of ways. According to the preferred embodiment shown in FIG. 3, the end portion 16 is provided with a knife edge 31. A wall 32 defining the recessed space 42 in the body 2 is provided with a platelet 33, shown in FIG. 4, with a matching groove 34 for the knife edge 31. The knife edge 31 accommodating for the rotational movement (over a small angle) when the arm 10 of the tremolo system is actuated or a string 5 breaks. The compensator means 13 are held against the matching groove 34 using screws 35, 35', which screws 35, 35' loosely fit into openings provided in the end portion 16. In this preferred embodiment, end portion 16 consists of 3 sections 16*a*, 16*a'* and 16*b*. The latter is perpendicular to the main body of the frame 40 and parallel to the adjustment wheel 26, and at the side opposite to the adjustment wheel 26 provided with the knife edge 31. The sections 16*a*, 16*a'* are at an angle to keep the compensator at the desired position and to facilitate mounting the compensator 13 in the recessed space 42 (driving in the screws 35, 35').

In the embodiment shown in FIG. 3, a second recess 36 is provided to accommodate the end of the rod 17 protruding from the second end portion 16.

The second compression spring 28 between the adjustment wheel 21 and the anchor 22 serves to soften the impact with which the anchor 22 engages the first compression spring 20 via tube 18. To this end, the anchor body 22 may be provided with a rubber-like bumper 27, such as made from poly urethane. Thus, when pivotting the arm 10, the force with which the tension on the strings 5 is varied kicks in more gradually, making playing more pleasant and avoiding unwanted sounds of the tremolo mechanism itself. Alternatively, a multiple of compression springs 20 may be used in the compensator 11 according to the present invention, together displaying an exponential increase in force required to compress the compression spring series. Such compression springs (replacing at least the single compression spring 20 indicated in the drawings) may comprise a spring having a wire thickness or pitch reduction over at least part of the length of the spring. However, a series of two or more compression springs, each with fixed wire thickness and varying in spring constant may be easier and cheaper to implement and gives quite satisfactory results.

If desired by the musician, the compensator according to the present invention allows the musician to play the guitar as if it had a fixed bridge (no tremolo capabilities). By operating the adjustment wheel 21 until the compression spring 20 is strongly compressed and by actuating the tremolo stop according to the invention, the tremolo system of the electric guitar, the optional effect is achieved.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

What is claimed is:

1. A compensator for a tremolo for a stringed musical instrument, which compensator comprises a rod, an elongated frame and an anchor means, the elongated frame having a first and a second frame end portion, the frame end portions being provided with an opening with respect to and through which the rod is capable of being moved, wherein the anchor means is attached to the rod;

a tube sleeved over said rod between the first frame end over part of the length of the rod between the first frame end portion and the anchor means, the tube being provided with threading and an adjustment wheel, a compression spring being sleeved over the tube and abutting against the first frame end portion; and an integrated tremolo stop, the tremolo stop comprising a hollow second adjustment wheel provided between the anchor means and the second frame end portion, where one of the anchor body and the hollow second adjustment wheel comprises a hollow bush sleeved over the rod, the hollow bush is provided with a thread, and the other of the anchor body and the second adjustment wheel is provided with a complementary thread, the rod being movable with respect to and through the hollow second adjustment wheel.

2. A compensator according to claim 1, wherein the anchor means comprises a) an anchor body attached to the rod, and b) a threaded hollow bush, the second adjustment wheel being provided with a complementary thread.

3. A compensator according to claim 1, wherein the adjustment wheel for compressing the compression spring is between the anchor means and the compression spring.

4. A compensator according to claim 1, wherein the tube is threaded at its end opposite to the first frame end portion.

5. A musical instrument comprising a tremolo, the tremolo comprising a tremolo system, said tremolo system comprising a tremolo arm for changing the pitch of the musical instrument, a lever arm and compensating means connected to said lever arm, the compensating means comprising a compensator and at least one pull spring, which compensator comprises a rod, an elongated frame and an anchor means, the elongated frame having a first and a second frame end portion, the frame end portions being provided with an opening with respect to and through which the rod is capable of being moved, wherein the anchor means is attached to the rod;

a tube sleeved over said rod between the first frame end over part of the length of the rod between the first frame end portion and the anchor means, the tube being provided with threading and an adjustment wheel, a compression spring being sleeved over the tube and abutting against the first frame end portion; and an integrated tremolo stop, the tremolo stop comprising a hollow second adjustment wheel provided between the anchor means and the second frame end portion, where one of the anchor body and the hollow second adjustment wheel comprises a hollow bush sleeved over the rod, the hollow bush is provided with a thread, and the other of the anchor body and the second adjustment wheel is provided with a complementary thread, the rod being movable with respect to and through the hollow second adjustment wheel.

6. A compensator according to claim 1, wherein the rod at its end away from the adjustment wheel is provided with a hook, which is inserteable into a hole in the lever arm, and wherein a clip is provided to keep said hook engaged in said hole.

7. A compensator according to claim 1, wherein the second end portion is provided with a knife edge;

wherein a wall defining the recessed space in the body is provided with a groove and wherein said groove optionally is provided in a platelet placed agains said wall; and wherein said groove matches with the knife edge.

* * * * *